US010761483B2

(12) United States Patent
Shibuya et al.

(10) Patent No.: US 10,761,483 B2
(45) Date of Patent: Sep. 1, 2020

(54) MECHANICAL PART, TIMEPIECE, AND METHOD OF MANUFACTURING A MECHANICAL PART

(71) Applicant: Seiko Epson Corporation, Tokyo (JP)

(72) Inventors: Munehiro Shibuya, Minamiminowa (JP); Takeo Funakawa, Chino (JP)

(73) Assignee: Seiko Epson Corporation (JP)

( * ) Notice: Subject to any disclaimer, the term of this patent is extended or adjusted under 35 U.S.C. 154(b) by 201 days.

(21) Appl. No.: 15/977,503

(22) Filed: May 11, 2018

(65) Prior Publication Data

US 2018/0335754 A1 Nov. 22, 2018

(30) Foreign Application Priority Data

May 16, 2017 (JP) ..... 2017-097043

(51) Int. Cl.
*G04B 13/02* (2006.01)
*G04B 15/14* (2006.01)

(52) U.S. Cl.
CPC ..... *G04B 13/026* (2013.01); *G04B 13/022* (2013.01); *G04B 15/14* (2013.01)

(58) Field of Classification Search
CPC ..... G04B 1/16; G04B 13/022; G04B 13/025; G04B 15/14; G04B 13/026; G04B 13/02; G04B 13/021; G04B 13/012; F16D 1/116; F16D 2001/103; F16D 2250/0084
USPC ..... 368/324, 322
See application file for complete search history.

(56) References Cited

U.S. PATENT DOCUMENTS 8,944,676 B2 * 2/2015 Conus ..... G04B 13/022 368/324
9,457,536 B2 * 10/2016 Conus ..... G04B 13/022
9,753,433 B2 * 9/2017 Tanabe ..... G04B 13/021
2011/0005055 A1 1/2011 Gigandet et al.
2011/0205856 A1 * 8/2011 Zaugg ..... G04B 13/025 368/185
2014/0226447 A1 8/2014 Lagorgette et al.
(Continued)

FOREIGN PATENT DOCUMENTS

EP 1705533 A1 9/2006
EP 1705533 B1 4/2010
EP 2219083 A1 8/2010
(Continued)

OTHER PUBLICATIONS

Extended European Search Report for Patent Application No. EP 18172330.5 dated Jan. 3, 2019 (9 pages).

*Primary Examiner* — Edwin A. Leon
(74) *Attorney, Agent, or Firm* — Harness, Dickey & Pierce, P.L.C.

(57) ABSTRACT

Provided are a mechanical part, a timepiece having the mechanical part, and a method of manufacturing a mechanical part that suppresses separation and rotation of a rotating member to a staff member, and can be manufactured at a competitive cost. A escape wheel and pinion 35 as an example of a mechanical part has a staff member 102; an escape wheel 101 with a hole 115 to which the staff member 102 is inserted, and ribs 112 that extend toward the staff member 102; and an annular fastening member 130 that affixes the escape wheel 101 to the staff member 102. The fastening member 130 is disposed touching the ribs 112 and deforming to protrude into the hole 115.

11 Claims, 10 Drawing Sheets

(56) References Cited

U.S. PATENT DOCUMENTS

| | | | |
|---|---|---|---|
| 2016/0266549 | A1 | 9/2016 | Stranczl |

FOREIGN PATENT DOCUMENTS

| | | | |
|---|---|---|---|
| EP | 2273322 | A1 | 1/2011 |
| EP | 2765462 | A1 | 8/2014 |
| EP | 3067756 | A1 | 9/2016 |
| JP | 2012-167808 | A | 9/2012 |
| JP | 2014-163737 | A | 9/2014 |

* cited by examiner

MECHANICAL PART, TIMEPIECE, AND METHOD OF MANUFACTURING A MECHANICAL PART

BACKGROUND

1. Technical Field

The present invention relates to a mechanical part, a timepiece, and a method of manufacturing a mechanical part.

2. Related Art

Mechanical timepieces comprise many wheels and numerous other mechanical parts. Mechanical parts such as wheels are disposed with a staff member inserted to a hole formed in the center of the rotating member having a plurality of teeth formed around the outside circumference.

Conventionally, such mechanical parts are machined from metal materials, but in more recent years silicon has also been used as a material for manufacturing mechanical parts for timepieces. Because mechanical parts made from a silicon substrate are lighter than parts made from a metal substrate, the inertia of the mechanical parts is also lower and improved energy transfer efficiency can be expected.

In addition, because silicon can be processed using technologies such as photolithography and etching, and can therefore be shaped with a high degree of freedom, using a silicon substrate also offers the benefit of improved precision processing mechanical parts.

EP1705533B1 describes a mechanical part that has a metal staff member inserted to a rotating member made of silicon, and is secured by a metal fastening member (washer). A protrusion (pin) that fits into a hole in the rotating member is disposed to the fastening member of the mechanical part described in EP1705533B1. By this pin fitting into the hole in the rotating member, separation of the rotating member from, and rotation of the rotating member relative to, the staff member are suppressed.

However, with the mechanical part described in EP1705533B1, machining processes such as cutting and grinding are required to form a pin (protrusion) on the metal fastening member. When the staff member and rotating member are secured by the fastening member, the hole in the rotating member and the protrusion on the fastening member must be aligned in the circumferential direction (rotational direction). This increases the number of processing and assembly steps, possibly increasing the cost of production.

In addition, if there is any deviation in processing precision during the machining process forming the protrusion on the fastening member, the positions of the staff member and fastening member may shift or vary when the staff member and fastening member are fastened together, or a gap may form between the staff member and fastening member, and the quality of the mechanical part may therefore drop.

SUMMARY

The present invention is directed to solving at least part of the foregoing problem, and can be achieved by the embodiments or examples described below.

EXAMPLE 1

A mechanical part according to this example includes: a staff member; a rotating member including a first hole in which the staff member is inserted, and a rib extending toward the staff member; and an annular fastening member configured to affix the rotating member to the staff member, the fastening member disposed in contact with the rib with part of the fastening member deformed and protruding into the first hole.

The configuration of a mechanical part according to this aspect of the invention has an annular fastening member configured to affix a rotating member to a staff member. Because the fastening member is disposed to contact the ribs of the rotating member, the position of the rotating member is fixed in the axial direction of the staff member. Furthermore, because part of the fastening member has a part (referred to below as a protrusion) that deforms and protrudes into the first hole, the position of the rotating member in the circumferential direction (direction of rotation) of the staff member is also fixed. As a result, a mechanical part that suppresses separation and rotation of the rotating member to the staff member can be provided.

EXAMPLE 2

Preferably in a mechanical part according to this example, the first hole is formed surrounded by a plurality of the ribs; and the fastening member is formed so that the part of the fastening member overlapping the first hole of the rotating member protrudes in the axial direction when seen in plan view from the axial direction of the staff member.

With the configuration of a mechanical part according to this example, because the part of the fastening member that overlaps the first hole surrounded by the rib protrudes in the axial direction past the part that overlaps the rib of the rotating member in plan view, the protrusion is formed desirably according to the shape of the first hole. Deviation and variation in the position of the fastening member to the rotating member can therefore be effectively suppressed.

EXAMPLE 3

Preferably in a mechanical part according to this example, the Vickers hardness of the fastening member is less than the Vickers hardness of the rotating member.

Because the Vickers hardness of the fastening member is less than the Vickers hardness of the rotating member in the configuration of a mechanical part according to this example, part of the fastening member can be plastically deformed and a protrusion formed by press fitting the fastening member to the rotating member.

More specifically, after disposing the fastening member in contact with the rib of the rotating member, the fastening member can be pressed to form the protrusion. As a result, the need for cutting, grinding or other machining process to form a protrusion on the fastening member can be eliminated, and positioning the fastening member and the rotating member in the circumferential direction can be eliminated.

In addition, because the part of the fastening member that overlaps the first hole can be made to protrude to the rotating member side past the part that overlaps the rib, deviation and variation in the position of the fastening member to the rotating member can be effectively suppressed, and the gap between the rotating member and fastening member can be reduced.

EXAMPLE 4

Preferably in a mechanical part according to this example, the staff member has, on the opposite side of the rotating member as the fastening member, a protrusion configured to protrude to an outside in a radial direction; and the diameter of the first surface of the fastening member that contacts the rib is less than or equal to the diameter of the surface of the protrusion that contacts the rotating member.

In this configuration of a mechanical part according to the invention, when pressing and plastically deforming part of the fastening member, force is transferred from the first surface of the fastening member to the rotating member supported by the surface of the protrusion from the staff member. Because the diameter of the first surface of the fastening member that contacts the rib is less than or equal to the diameter of the surface of the protrusion that contacts the rotating member, the force applied to the rotating member by pressing the fastening member is supported in the area of the surface of the protrusion contacting the rotating member. As a result, warping or other deformation or damage to the rotating member by pressing on the fastening member can be suppressed.

EXAMPLE 5

Preferably in a mechanical part according to this example, the diameter of a second surface of the fastening member, which is the opposite side as the first surface, is greater than or equal to the diameter of the first surface.

In this configuration of a mechanical part according to the invention, the diameter of the second surface to which force is applied when pressing on the fastening member is greater than or equal to the diameter of the first surface that contacts the rib. As a result, the diameter of the second surface used to push the fastening member can be increased, and the fastening member can be easily pressed into position, without making the diameter of the first surface that contacts the rib greater than the diameter of the surface that contacts the rotating member.

EXAMPLE 6

Preferably in a mechanical part according to this example, the rotating member has a rim part with a plurality of teeth, and a flexible part and a second hole disposed between the ribs and the rim part.

In this configuration of a mechanical part according to the invention, because there is a flexible member between the rib and rim, stress on the rib is relieved, and a holding force sufficient for the rib to hold the staff member is achieved, by the elasticity of the flexible member.

EXAMPLE 7

A timepiece according to another aspect of the invention has a mechanical part according to the invention as described above.

Because a mechanical part according to the invention as described above is used in a timepiece configured according to this aspect of the invention, a cost-competitive timepiece with outstanding quality and high precision can be provided.

EXAMPLE 8

Another aspect of the invention is a manufacturing method of a mechanical part including: a process of forming a rotating member having a rib extending toward a center part, and a first hole enclosed by the rib; a process of inserting a staff member into the first hole of the rotating member; a process of inserting the staff member into a hole in an annular fastening member so that the fastening member contacts the rib of the rotating member; and a process of pressing the fastening member to deform part of the fastening member to protrude into the first hole of the rotating member.

The manufacturing method of a mechanical part according to this aspect of the invention inserts a staff member to a first hole in a rotating member, and then inserts the staff member to a hole in an annular fastening member so that the fastening member contacts a rib of the rotating member. Because the fastening member is then pressed so that part of the fastening member deforms and protrudes into the first hole in the rotating member, a protrusion can be formed on the fastening member after inserting the staff member to the hole in the fastening member.

More specifically, because a protrusion does not need to be previously formed on the fastening member, machining processes such as cutting and grinding to form a protrusion on the fastening member are not needed, and there is no need to position a protrusion in the first hole of the rotating member when inserting the staff member to the hole in the fastening member. As a result, the production cost of the mechanical part can be reduced because the number of processing and assembly steps can be reduced.

In addition, because the part of the fastening member that overlaps the first hole in the rotating member protrudes into the first hole, a protrusion matching the shape of the first hole can be formed. As a result, because deviation and variation the positioning of the rotating member can be suppressed, and the gap between the rotating member and fastening member can be reduced, separation and rotation of the rotating member on the staff member can be suppressed by the fastening member, and a mechanical part with excellent quality can be manufactured.

EXAMPLE 9

In a manufacturing method of a mechanical part according to another example, in the process of inserting the staff member into a hole in the fastening member, the inside diameter of the hole in the fastening member is smaller than the outside diameter of the staff member.

Because the inside diameter of the hole in the fastening member is smaller than the outside diameter of the staff member, the fastening member can be spread to the outside by inserting the staff member into the hole in the fastening member in the manufacturing method of a mechanical part according to this aspect of the invention. Because the stress produced at this time secures the fastening member to the staff member, the rotating member can be more reliably fixed on the staff member by the fastening member.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the invention is described below with reference to the accompanying figures. Note that this embodiment of the invention describes a mechanical timepiece as an example of a timepiece according to the invention. As an example of a mechanical part according to the invention, this embodiment also describes an escape wheel, which is an example of a wheel embodying a mechanical part in a movement of a mechanical timepiece. Note also that to show different layers and members in a size large enough to be recognized and understood, the scale of the layers and members may differ from the actual scale and size.

Embodiment 1

Mechanical Timepiece

Figure 1:
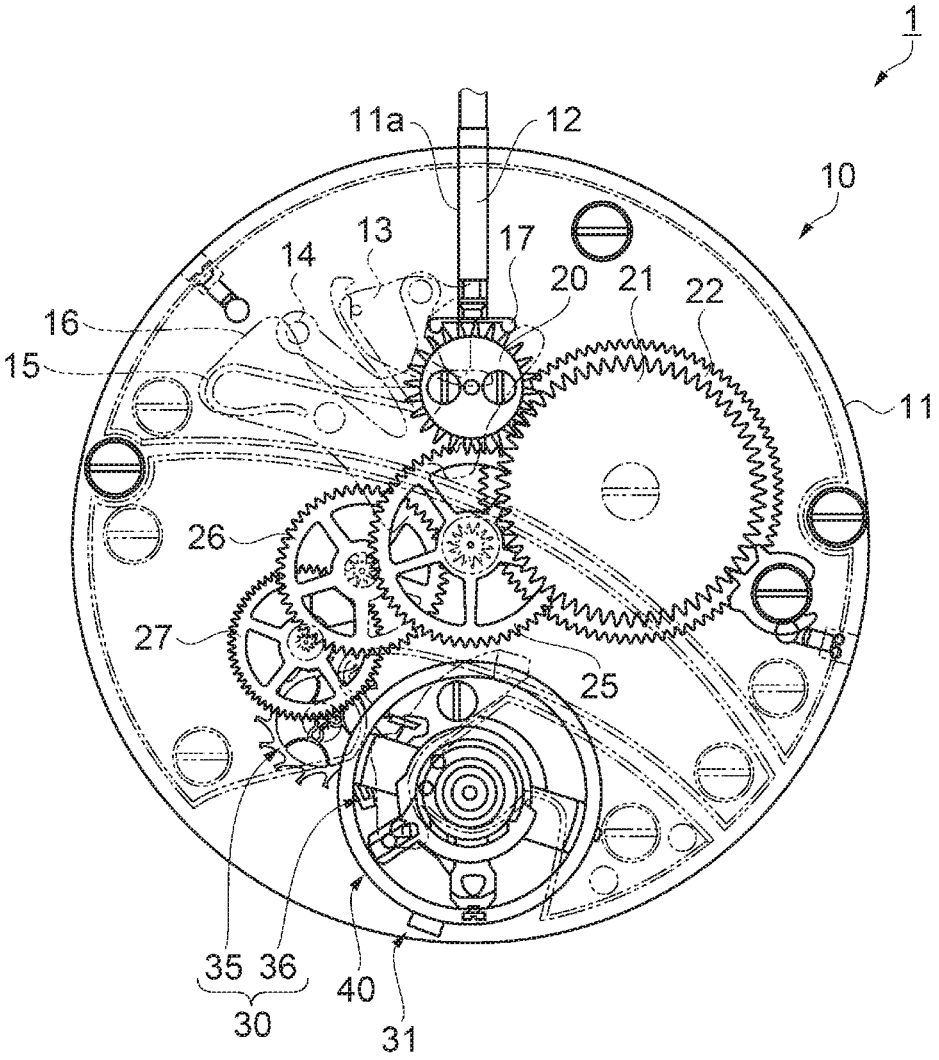
FIG. 1 is a plan view from the front side of the movement of a mechanical timepiece according to a preferred embodiment of the invention.

A mechanical timepiece 1 is described first as an example of a timepiece according to this embodiment of the invention. FIG. 1 is a plan view from the front side of the movement of a mechanical timepiece according to this embodiment of the invention. As shown in FIG. 1, a mechanical timepiece 1 according to this embodiment has a movement 10, and a casing not shown that holds the movement 10.

The side of the movement as shown in FIG. 1 is referred to as the front side, and the opposite side of the movement is referred to as the back side. The movement 10 has a main plate 11 embodying the substrate. A dial not shown in disposed on the back side of the main plate 11. Note that the wheel train assembled on the front side of the movement 10 is referred to as the front wheel train, and the wheel train assembled on the back side of the movement 10 is referred to as the back wheel train.

A winding stem guide hole 11*a* is formed in the main plate 11, and a winding stem 12 is assembled freely rotatably inside the winding stem guide hole 11*a*.

The position of the winding stem 12 on its axis of rotation is determined by a switching mechanism including a setting lever 13, yoke 14, yoke spring 15, and setting lever jumper 16. A winding pinion 17 is disposed freely rotatably to the guide shaft part of the winding stem 12.

In this configuration, when the winding stem 12 is pushed in along the axis of rotation to the first winding stem position (zero stop) closest to the center of the movement 10 and the winding stem 12 is then turned, the winding pinion 17 turns through rotation of an intervening sliding pinion not shown. Rotation of the winding pinion 17 causes the crown wheel 20 meshed with the winding pinion 17 to turn. Rotation of the crown wheel 20 causes the ratchet wheel 21 meshed with the crown wheel 20 to turn. Rotation of the ratchet wheel 21 then winds the main spring (drive power source) not shown housed inside the barrel wheel 22.

The front wheel train of the movement 10 includes, in addition to the barrel wheel 22 (mechanical part) described above, a center wheel (mechanical part) 25, a third wheel (mechanical part) 26, and a fourth wheel (mechanical part) 27, and functions to transfer torque from the barrel wheel 22. Also disposed on the front side of the movement 10 are an escapement 30 and regulator 31 for controlling rotation of the front wheel train.

The center wheel 25 is a wheel that meshes with the barrel wheel 22. The third wheel 26 is a wheel that meshes with the center wheel 25. The fourth wheel 27 is a wheel that meshes with the third wheel 26. The escapement 30 is a mechanism controlling rotation of the front wheel train described above, and includes an escape wheel (mechanical part) 35 that meshes with the fourth wheel 27, and a pallet fork (anchor striker) (mechanical part) 36 that advances and causes the escape wheel and pinion 35 to rotate isochronally. The regulator 31 is a mechanism that regulates the escapement 30 described above, and includes a balance (mechanical part) 40.

Escape Wheel and Pinion

The escape wheel and pinion 35 of the escapement 30 according to this embodiment of the invention is described in detail next.

Figure 2:
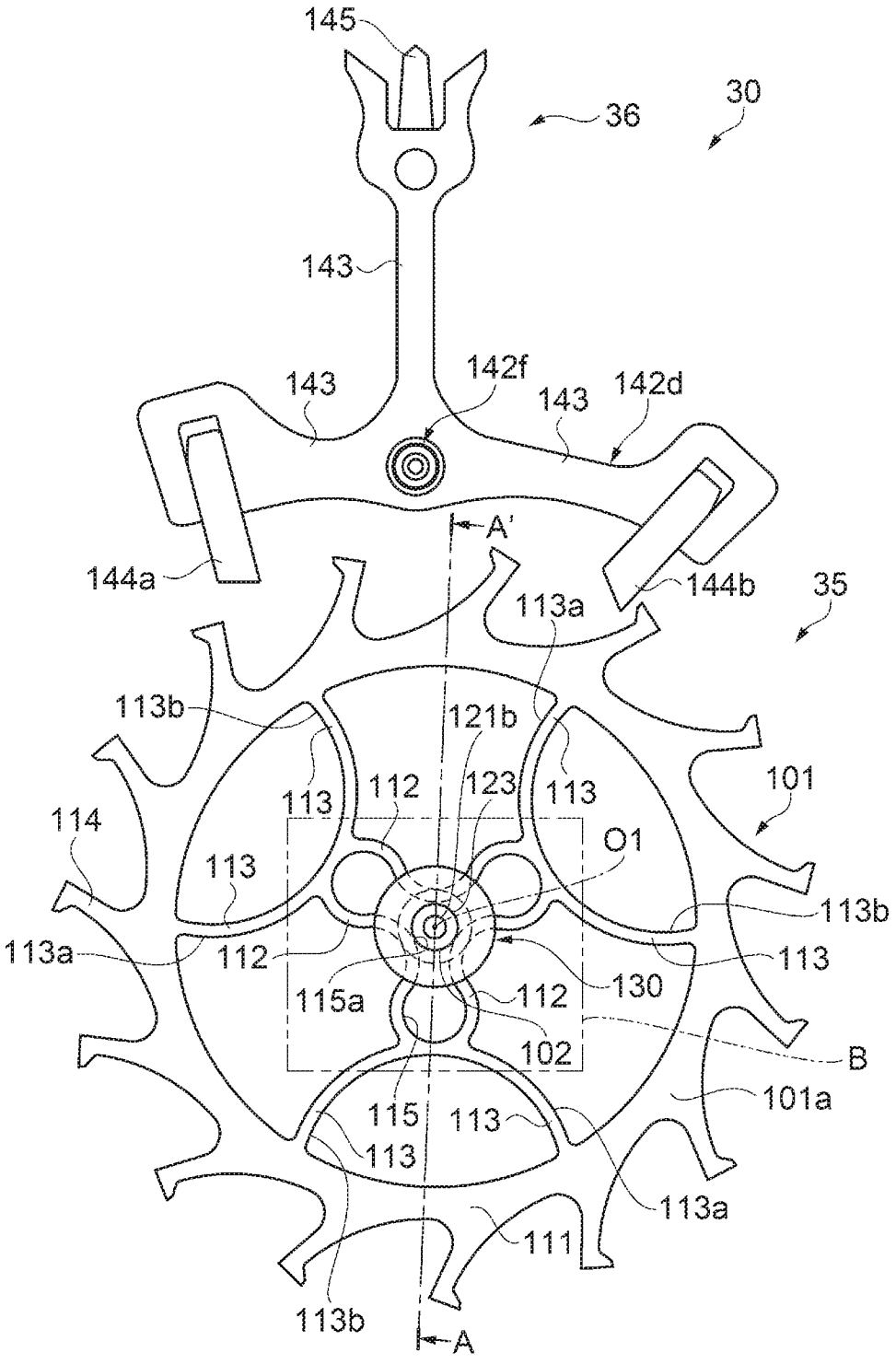
FIG. 2 is a plan view of the escapement according to a preferred embodiment of the invention.
Figure 3:
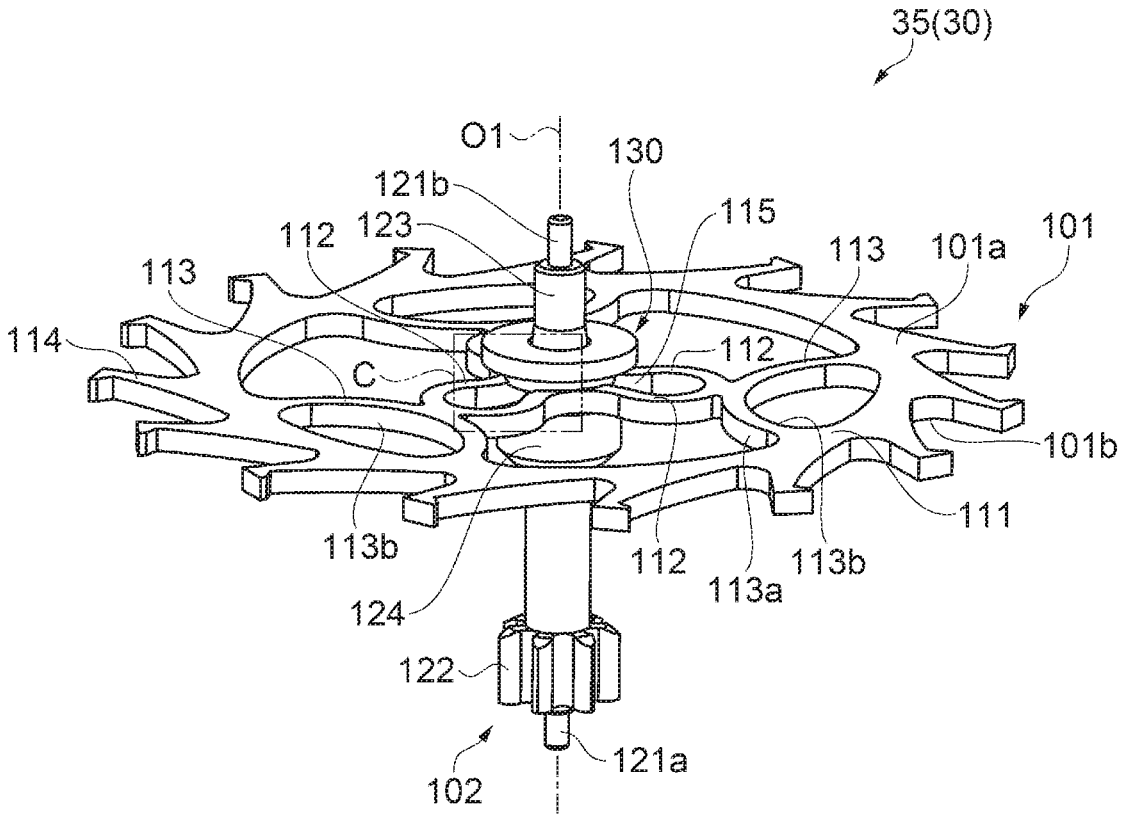
FIG. 3 is an oblique view of an escape wheel as an example of a mechanical part according to the invention.
Figure 4:
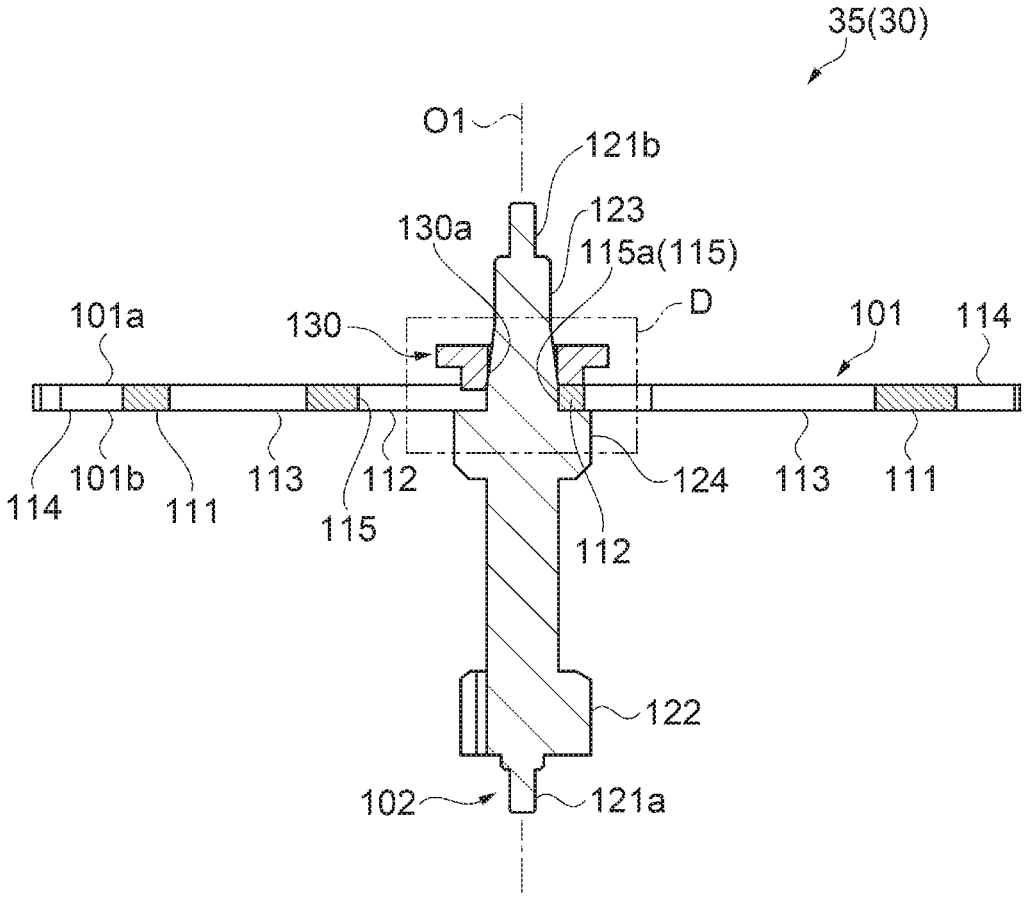
FIG. 4 is a section view through A-A' in FIG. 2.
Figure 5:
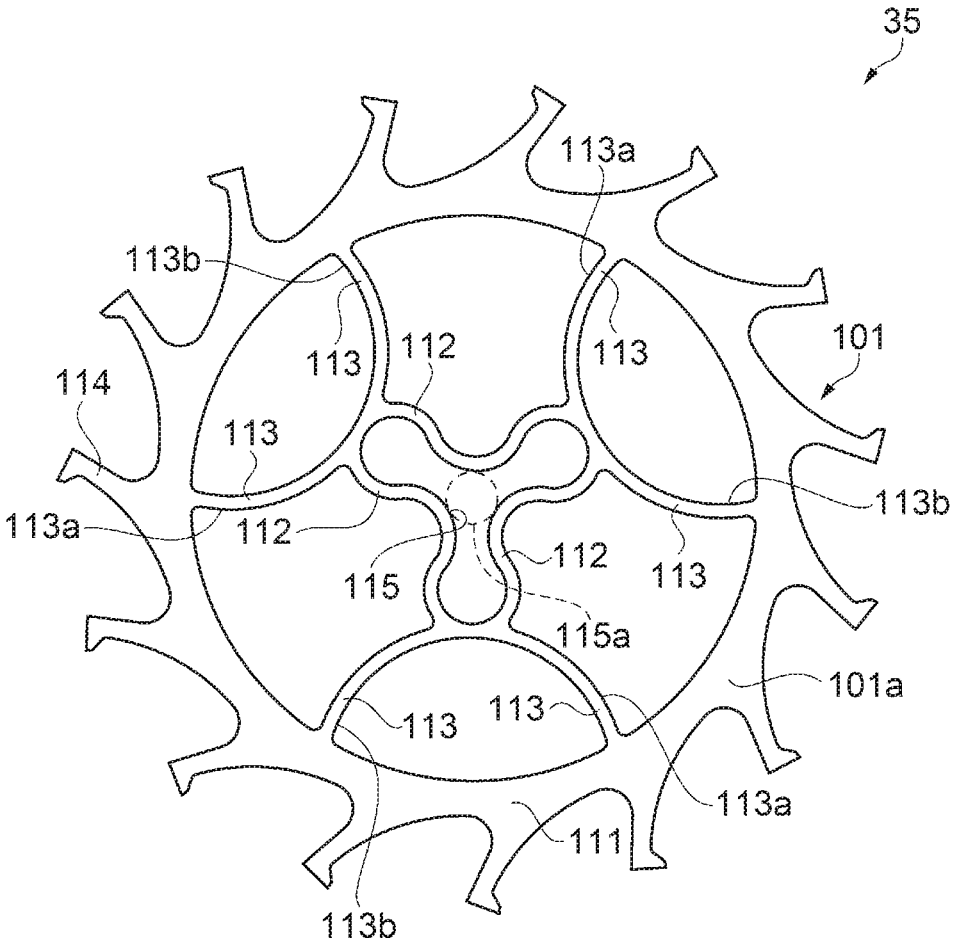
FIG. 5 is a plan view of an escape wheel as an example of a rotating member according to the invention.

FIG. 2 is a plan view of the escapement according to this embodiment of the invention. FIG. 3 is an oblique view of an escape wheel as an example of a mechanical part according to the invention. FIG. 4 is a section view through A-A' in FIG. 2. FIG. 5 is a plan view of an escape wheel as an example of a rotating member according to the invention.

As shown in FIG. 2 to FIG. 4, the escape wheel and pinion 35 of the escapement 30 includes an escape wheel 101 as a rotating member, a pinion (rotary staff) 102 affixed coaxially (on axis O1) to the escape wheel 101, and an annular fastening member 130 holding the escape wheel 101 and pinion 102 together.

Below, the direction along the axis O1 of the escape wheel 101 and pinion 102 is referred to simply as the axial direction, the direction perpendicular to the axis O1 is referred to as the radial direction, and the direction of rotation around the axis O1 is referred to as the circumferential direction. Note also that the axis O1 side of the radial direction is referred to as the inside, and the side away from the axis O1 is referred to as the outside.

As shown in FIG. 2 to FIG. 5, the escape wheel 101 is a disc of a uniform thickness throughout, and the front side 101*a*, which is one side, and the back side 101*b*, which is the opposite side as the one side, are flat. The escape wheel 101 is made from monocrystalline silicon or other material with a crystal orientation, or from a metal material. The escape wheel 101 has ribs 112, a hole 115 as a first opening, flexible parts 113, holes 113*a* and holes 113*b* as second openings, and a rim 111.

A plurality of ribs 112 are disposed in the center of the escape wheel 101, and are formed curving to the inside toward the pinion 102. In this embodiment of the invention, the escape wheel 101 has three ribs 112.

The hole 115 is a through-hole formed so as to be surrounded by the multiple ribs 112. The pinion 102 is inserted to the hole 115, and is held by the inside peaks of the three ribs 112. As a result, the pinion 102 is supported with the axis O1 thereof positioned in the center of the escape wheel 101.

The flexible parts 113 are parts connected to the ribs 112 and rim 111, and are formed as multiple spokes. Each flexible part 113 extends in an arc radiating in two branches from the adjacent rib 112 to the inside circumference side of the rim 111. The holes 113*a* are through-holes formed so as to be surrounded by a rib 112, a flexible part 113, and the rim 111. The other holes 113*b* are through-holes formed so as to be surrounded by a flexible parts 113 and the rim 111.

Because there are flexible parts 113 between the ribs 112 and rim 111, stress applied to the ribs 112 is relieved by the flexibility of the flexible parts 113, while the ribs 112 have sufficient holding power to hold the pinion 102.

The rim 111 is disposed around the escape wheel 101. Around the outside circumference of the rim 111, a plurality of teeth 114 with a specific hook shape are formed projecting to the outside in the radial direction.

As shown in FIG. 2, the multiple teeth 114 of the escape wheel and pinion 35 engage the pallet 36. The pallet 36 has a T-shaped anchor 142*d* formed by three anchor beams (lever and pallets) 143, and a pallet staff 142*f*, which is a pivot. The anchor 142*d* is configured to pivot on the pallet staff 142*f*. Note that the ends of the pallet staff 142*f* are supported rotatably by the main plate 11 described above and an anchor bridge not shown.

Of the three anchor beams 143, a pallet stone 144*a* and 144*b* is disposed to two of the anchor beams (pallets) 143, and a guard pin 145 is disposed to the distal end of the remaining one anchor beam (lever) 143. The pallet stones 144*a* and 144*b* are rubies shaped like rectangular columns, and are affixed to the anchor beams 143 by adhesive, for example.

When the pallet 36 thus comprised pivots on the pallet staff 142*f*, pallet stone 144*a* or pallet stone 144*b* contacts the distal end of a tooth 114 of the escape wheel and pinion 35. The anchor beam (lever) 143 to which the guard pin 145 is attached then contacts a banking pin not shown, thereby preventing the pallet 36 from pivoting further in the same direction. As a result, rotation of the escape wheel and pinion 35 is also stopped temporarily.

Because the substantially of the escape wheel 101 is silicon, and the escape wheel 101 can therefore be formed using technology such as photolithography or etching, parts can be easily formed to the desired shape, and processing precision thereof can be improved. Furthermore, by using silicon for the substrate of the escape wheel 101, the escape wheel 101 can be made lighter than if it was made from a metal substrate, the inertia of the escape wheel 101 can be reduced, and energy transfer efficiency can be improved.

As shown in FIG. 3 and FIG. 4, the pinion 102 has tenons 121*a* and 121*b*, an escape pinion 122, a press-fit staff 123, and a flange 124 as a protruding shoulder. The tenons 121*a* and 121*b* are disposed to the distal axial ends of the pinion 102. Of the tenons 121*a* and 121*b*, the one tenon 121*a* on one axial end is supported rotatably by a wheel train bridge not shown, and the other tenon 121*b* on the other axial end is supported rotatably by the main plate 11 described above.

The escape pinion 122 is formed near the one-end tenon 121*a* of the pinion 102. The escape pinion 122 meshes with the teeth of the fourth wheel 27 (see FIG. 1) described above. By the escape pinion 122 meshing with the fourth wheel 27, torque from the fourth wheel 27 is transferred to the pinion 102, and the escape wheel and pinion 35 turns.

The press-fit staff 123 is larger in diameter than the tenons 121*a* and 121*b* described above. The press-fit staff 123 is inserted from the back side 101*b* to the hole 115 surrounded by the multiple ribs 112 of the escape wheel 101. The press-fit staff 123 is disposed inside the hole 115 in contact with the inside peaks of the ribs 112 with part of the press-fit staff 123 protruding from the front side 101*a* of the escape wheel 101 to the other axial end.

The diameter of the inscribed circle 115*a* (see FIG. 2 and FIG. 5) to the peaks of the three ribs 112 projecting toward the press-fit staff 123 of the pinion 102 when the pinion 102 is not inserted to the hole 115 (see FIG. 5) is designed to be smaller than the diameter of the press-fit staff 123 of the pinion 102. Therefore, when the pinion 102 is inserted to the hole 115 of the escape wheel 101, the ribs 112 contacting the press-fit staff 123 deform to the outside in the radial direction. The pinion 102 is positioned and held in the center of the escape wheel 101 by the stress produced by this deformation.

The flange 124 are formed to project to the outside in the radial direction between the escape pinion 122 and the press-fit staff 123 of the pinion 102. The flange 124 is disposed on the opposite side of the escape wheel 101 as the fastening member 130 with the escape wheel 101 therebetween. The diameter of the flange 124 is larger than the diameter of the press-fit staff 123. The diameter of the flange 124 is therefore larger than the diameter of the inscribed circle 115*a* to the peaks of the three ribs 112.

The face 125 on the tenon 121*b* of the flange 124 (see FIG. 6) contacts the back side 101*b* of the escape wheel 101 (ribs 112). This determines (limits) the position of the escape wheel 101 in the axial direction of the pinion 102 (the direction toward the one-end tenon 121*a*).

The pinion 102 is made from a metal material that offers excellent rigidity and heat resistance, and good excellent processability by cutting, machining, and grinding, for example. The pinion 102 is preferably made from carbon steel.

The fastening member 130 is an annular member with a hole 130*a* (see FIG. 4). The fastening member 130 is round in plan view (see FIG. 2). The pinion 102 is inserted inside the hole 130*a* in the fastening member 130. In other words, the fastening member 130 is pushed onto the press-fit staff 123 of the pinion 102 from the other-end tenon 121*b* side.

The fastening member 130 is disposed in the axial direction of the pinion 102 on the other-end tenon 121*b* side of the escape wheel 101 opposite the flange 124 with the escape wheel 101 therebetween. The inside diameter of the hole 130*a* in the fastening member 130 is designed to be smaller than the outside diameter of the press-fit staff 123 part of the pinion 102. Therefore, the fastening member 130 is affixed to the pinion 102 when the fastening member 130 is pushed onto the pinion 102 (that is, when the pinion 102 is inserted inside the hole 130*a* of the fastening member 130).

Figure 6:
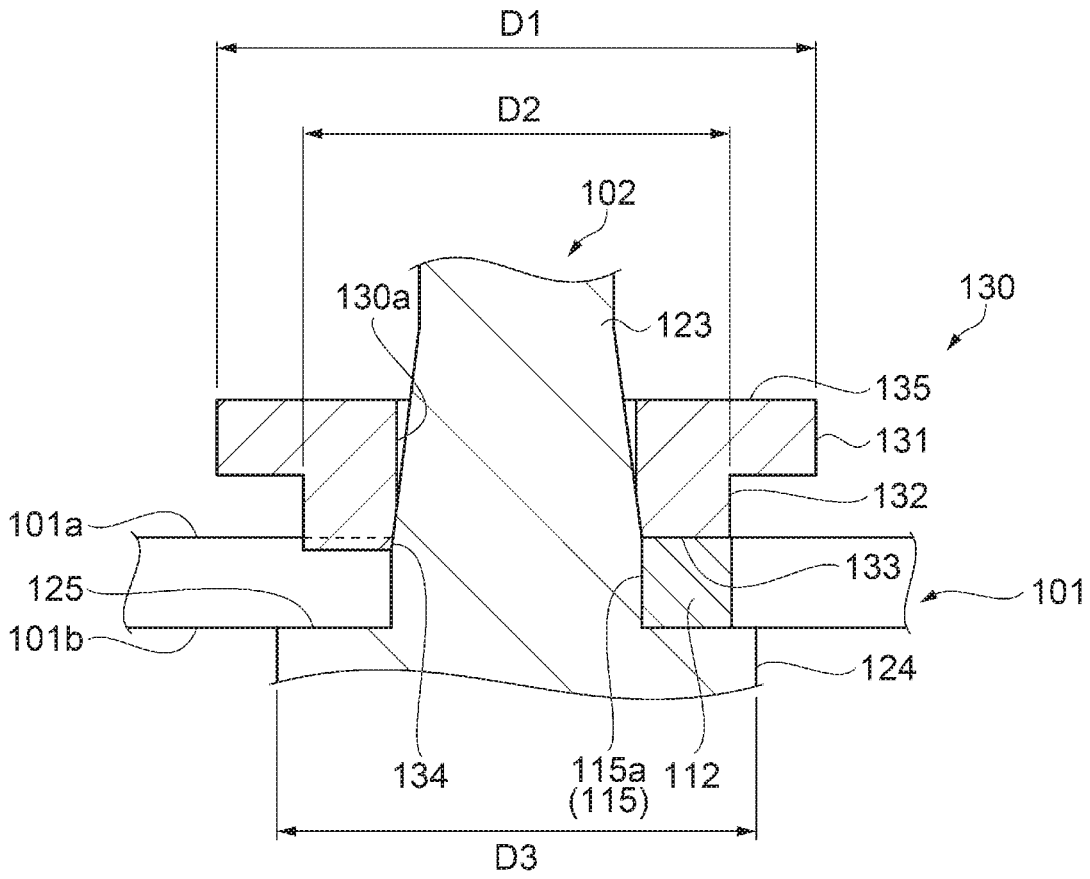
FIG. 6 is an enlarged partial section view of area D in FIG. 4.
Figure 7:
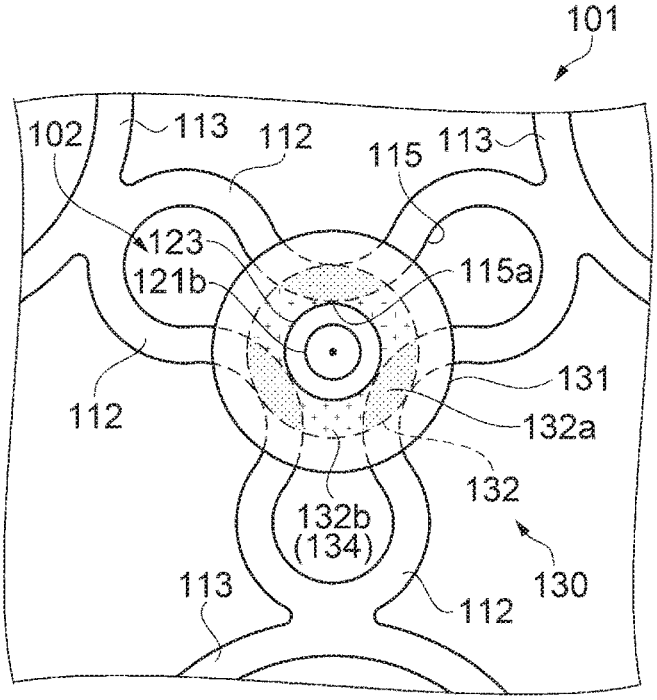
FIG. 7 is an enlarged partial section view of area B in FIG. 2.
Figure 8:
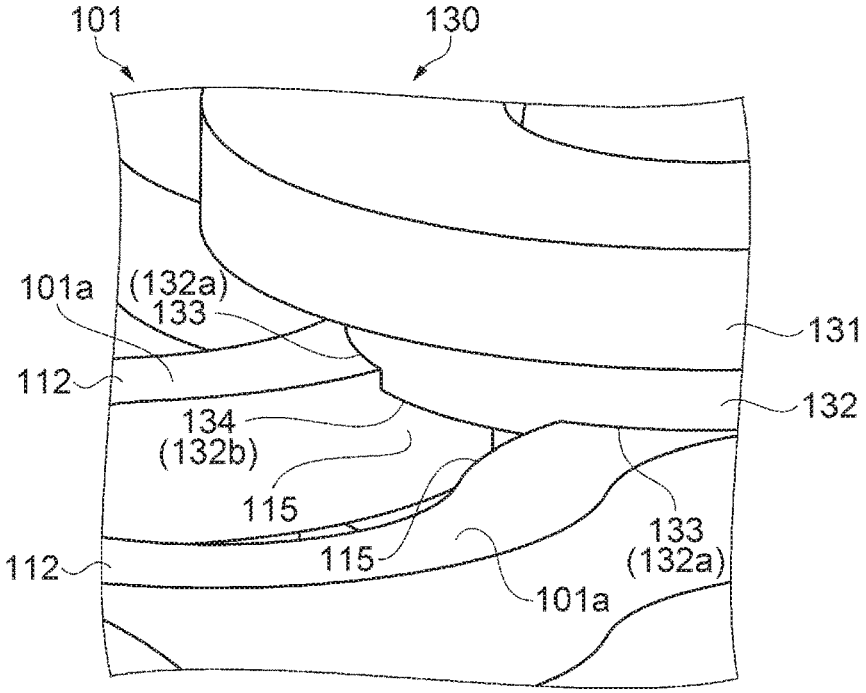
FIG. 8 is an enlarged partial section view of area C in FIG. 3.

The detailed configuration of the fastening member 130 is described next with reference to FIG. 6 to FIG. 8. FIG. 6 is an enlarged partial section view of area D in FIG. 4. FIG. 7 is an enlarged partial section view of area B in FIG. 2. FIG. 8 is an enlarged partial section view of area C in FIG. 3.

As shown in FIG. 6, the fastening member 130 has a large diameter part 131, and a small diameter part 132 connected to the large diameter part 131 in the axial direction. The hole 130*a* passes through the large diameter part 131 and small diameter part 132. The fastening member 130 is installed with the small diameter part 132 facing the escape wheel 101.

The surface of the small diameter part 132 on the escape wheel 101 is referred to below as first surface 133 (first surface). This first surface 133 of the small diameter part 132 contacts the front side 101*a* of the escape wheel 101 (ribs 112). The surface of the large diameter part 131 on the opposite side as the escape wheel 101 is referred to as the second surface 135 (second surface). The diameter D2 of the first surface 133 of the small diameter part 132 is less than or equal to the diameter D3 of the face 125 of the flange 124. The diameter D1 of the second surface 135 of the large diameter part 131 is greater than or equal to the diameter D2 of the first surface 133 of the small diameter part 132, and is preferably greater than or equal to diameter D3 of the face 125 of the flange 124.

The fastening member 130 is disposed so that it touches and partially deforms the ribs 112, and protrudes into the hole 115. More specifically, the fastening member 130 has a protrusion 134 formed to protrude in the axial direction from the first surface 133 of the small diameter part 132 that contacts the front side 101*a* of the ribs 112 (escape wheel 101).

As shown in FIG. 7, when seen in plan view from the axial direction of the pinion 102, the small diameter part 132 of the fastening member 130 has a part 132*a* that overlaps the ribs 112 of the escape wheel 101, and a part 132*b* that overlaps the hole 115 in the escape wheel 101. In other words, the small diameter part 132 of the fastening member 130 has parts 132*a* that contact the first surface 133 of the ribs 112 ((see FIG. 8), and parts 132*b* that do not contact the ribs 112.

As shown in FIG. 8, the part 132*a* of the small diameter part 132 that overlaps the ribs 112 contacts the front side 101*a* of the ribs 112 with the first surface 133. As a result, the position of the escape wheel 101 in the axial direction of the pinion 102 (the direction toward the other-end tenon 121*b*) is fixed. As a result, the escape wheel 101 is affixed to the pinion 102 between the fastening member 130 and flange 124.

The part 132*b* of the small diameter part 132 that overlaps the hole 115 protrudes in the axial direction from the first surface 133 of the part 132*a*. The part 132*b* of the small diameter part 132 that protrudes from the first surface 133 to the inside of the hole 115 in the axial direction is the protrusion 134. This protrusion 134 contacts the inside surface (the surface along the axial direction) of the ribs 112 in the circumferential direction (the direction of rotation of the escape wheel 101 and pinion 102). As a result, the position of the escape wheel 101 is limited in the circumferential direction. The distance the protrusion 134 protrudes from the first surface 133 is preferably greater than or equal to 3 μm.

As described above, because the position of the escape wheel 101 in the axial direction and the circumferential direction is determined by the fastening member 130, the escape wheel 101 is prevented from separating from and rotating on the pinion 102.

The fastening member 130 is formed from a metal material that has excellent processability, including machining and grinding, and is softer than the escape wheel 101. More specifically, the Vickers hardness (VH) of the fastening member 130 is lower than the Vickers hardness of the escape wheel 101. The Vickers hardness (VH) of the fastening member 130 is preferably also lower than the Vickers hardness of the pinion 102. The material of the fastening member 130 in this example is brass.

The Vickers hardness of brass depends on the composition, but is typically 50 HV to 200 HV.

When the escape wheel 101 is made from monocrystalline silicon, the Vickers hardness of the escape wheel 101 is approximately 1040 HV.

When the pinion 102 is made from carbon steel, the Vickers hardness is approximately 210 HV to 300 HV.

The fastening member 130 may be made from an aluminum alloy, bronze, iron, or a titanium alloy.

As described in detail below, in this embodiment of the invention the protrusion 134 is formed by applying pressure to the fastening member 130 with the fastening member 130 in contact with the escape wheel 101, causing plastic deformation of part of the fastening member 130 (part 132*b* of the small diameter part 132). By forming the protrusion 134 in this way, the protrusion 134 can be formed to match the shape of the hole 115 (the shape of the ribs 112), and there is no need to specifically position the fastening member 130 to the escape wheel 101. In addition, an offset or deviation in the position of the fastening member 130 to the escape wheel 101 can be suppressed.

Method of Manufacturing an Escape Wheel

Figure 9:
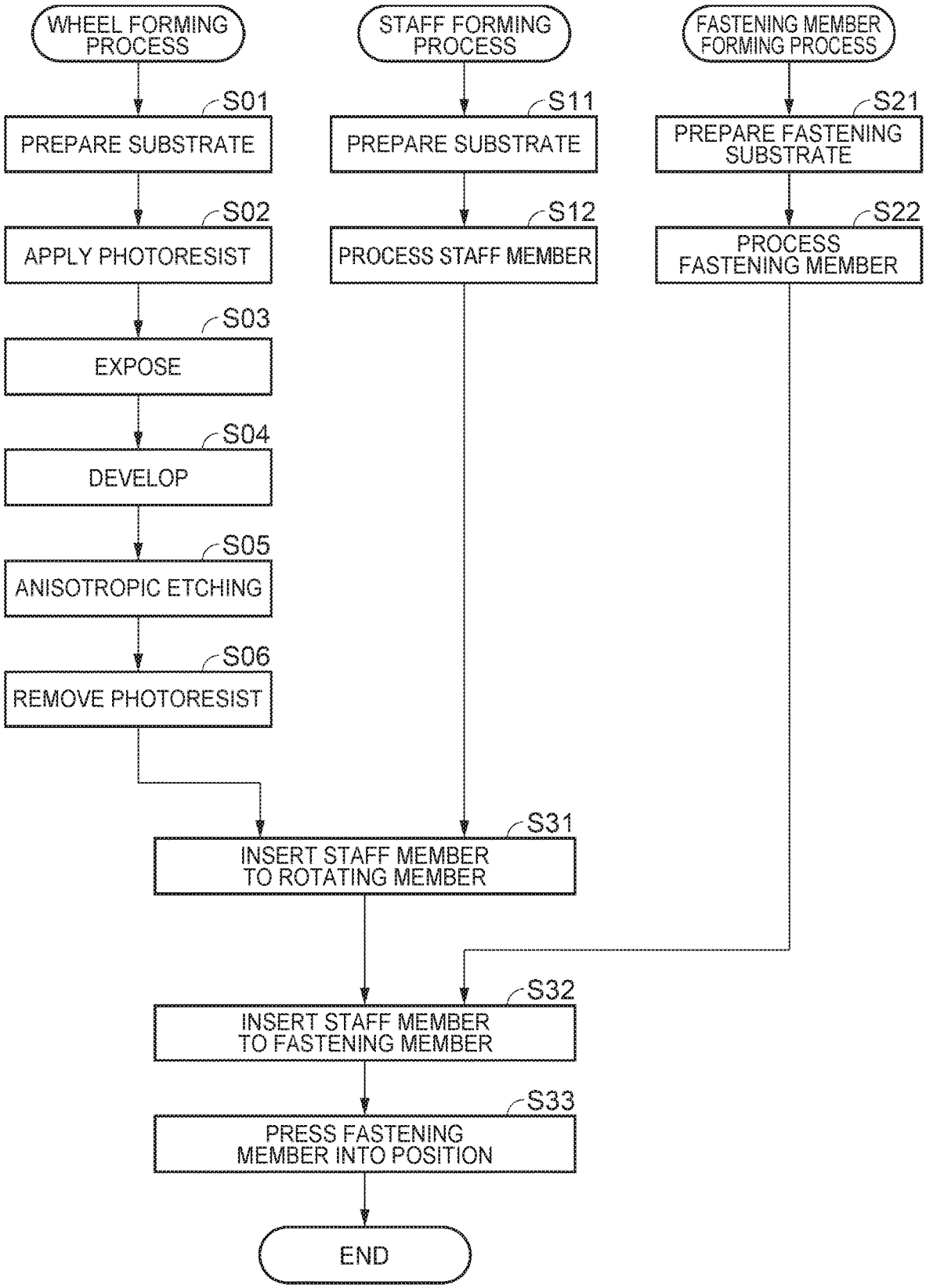
FIG. 9 is a flow chart describing the method of manufacturing an escape wheel according to the invention.

A method of manufacturing an escape wheel and pinion 35 as an example of a mechanical part according to this embodiment of the invention is described next. FIG. 9 is a flow chart describing the method of manufacturing an escape wheel according to the invention. FIG. 10 to FIG. 13 are schematic section views illustrating the process of inserting a staff member to the fastening member. FIG. 10 to FIG. 13 are enlarged partial section views of main parts of FIG. 4.

As shown in FIG. 9, a method of manufacturing an escape wheel and pinion 35 as an example of a mechanical part according to this embodiment of the invention includes a process of forming the toothed part of the rotating member (escape wheel 101), a process of forming the pinion 102 (staff part), a process of forming the fastening member 130, and a process of assembling these to make an escape wheel and pinion 35.

The process of forming the toothed part of the escape wheel 101 includes step S01 to step S06. First, a silicon wafer is prepared as a substrate (step S01). By forming the escape wheel 101 from silicon, the escape wheel 101 its parts can be formed to the desired shape using technologies such as photolithography and etching, and processing precision can be improved.

Next, a photoresist is applied to the surface of the substrate by spin coating or spray coating, for example (step S02). The photoresist applied in step S02 may be made from either a negative or positive photoresist material.

Next, the photoresist applied to the surface of the substrate is exposed using photolithographic technology (step S03), and developed (step S04). As a result, a photoresist pattern is formed as a mask (etching mask) corresponding to the desired plane shape of the escape wheel 101 shown in FIG. 5.

Next, using the photoresist pattern formed in step S03 and step S04 in FIG. 9 as a mask, the substrate is etched by an anisotropic etching process such as deep reactive ion etching (DRIE) (step S05). As a result, the substrate is etched deeply perpendicularly from the surface through the photoresist pattern, and the outside shape of an escape wheel 101 having ribs 112, a hole 115, flexible parts 113, holes 113*a* and holes 113*b*, and a rim 111 as shown in FIG. 5 is acquired.

Next, the photoresist (photoresist pattern) is removed (step S06 in FIG. 9). In step S06, the photoresist can be removed by, for example, wet etching that dissolves and strips the photoresist with white fuming nitric acid (WFNA) or an organic solvent, or by oxygen plasma asking. This completes the process of forming the escape wheel 101.

Note that when anisotropic etching is applied to the substrate in step S05, a mask protecting the back side of the substrate may be formed. By forming a protective mask on the back side of the substrate, the substrate will not be etched from the back in step S05, changing the shape of the side walls (the sides along the axial direction) of the ribs 112 can be prevented, and a escape wheel 101 having the cross sectional shape as shown in FIG. 4 can be acquired.

The process of forming the pinion 102 includes step S11 and step S12 in FIG. 9. The process of forming the pinion 102 is executed separately from the process of forming the escape wheel 101 in step S01 to step S06.

First, a member that will become the pinion 102 is prepared (step S11). The pinion 102 preferably has sufficient rigidity to function as a staff, and heat resistance. Because carbon steel is a material with excellent rigidity and heat resistance, and can be easily processed by machining and grinding, carbon steel is particularly well suited as the material of the pinion 102. Note that tantalum (Ta) and tungsten (W) may also be used.

Next, the member that becomes the pinion 102 is mechanically processed by cutting and grinding, for example (step S12). As a result, a pinion 102 having tenons 121*a* and 121*b*, an escape pinion 122, a press-fit staff 123, and a flange 124 such as shown in FIG. 3 and FIG. 4 can be acquired.

The process of forming the fastening member 130 includes step S21 and step S22 in FIG. 9. The process of forming the fastening member 130 is also executed separately from the process of forming the escape wheel 101 in step S01 to step S06, and the process of forming the pinion 102 in step S11 and step S12.

First, a member that will become the fastening member 130 is prepared (step S21). The material of the fastening member 130 has good processability by machining or grinding, for example, and a Vickers hardness that is lower than the Vickers hardness of the escape wheel 101, such as brass or other metal material.

Next, the member that becomes the fastening member 130 is mechanically processed by cutting and grinding, for example (step S22). As a result, a fastening member 130 having a large diameter part 131, a small diameter part 132, and an hole 130*a* such as shown in FIG. 6 and FIG. 7 is shaped.

The process of assembling the escape wheel and pinion 35 includes step S31 to step S33 in FIG. 9.

First, the pinion 102 formed in step S11 and step S12 is inserted to the escape wheel 101 formed in step S01 to step S06 (step S31). In step S31, the pinion 102 is inserted to the inscribed circle 115*a* (see FIG. 5) to the peaks of the three ribs 112 inside the hole 115 in the escape wheel 101 so that the face 125 of the flange 124 contacts the back side 101*b* of the ribs 112 (see FIG. 6).

As described above, the diameter of the inscribed circle 115*a* inside the hole 115 of the escape wheel 101 is designed to be smaller than the diameter of the press-fit staff 123 of the pinion 102. As a result, when the pinion 102 is inserted to the hole 115, stress is applied to the escape wheel 101 pushing the ribs 112 contacting the press-fit staff 123 to the outside in the radial direction. In addition, the elasticity of the flexible parts 113 disposed between the ribs 112 and rim 111 relieves the stress applied to the ribs 112 and suppresses damage to the escape wheel 101 while positioning and holding the pinion 102 in the center of the escape wheel 101 with appropriate force.

Next, the pinion 102 is inserted into the hole 130*a* of the fastening member 130 that was formed in step S21 and step S22 (step S32).

Figure 10:
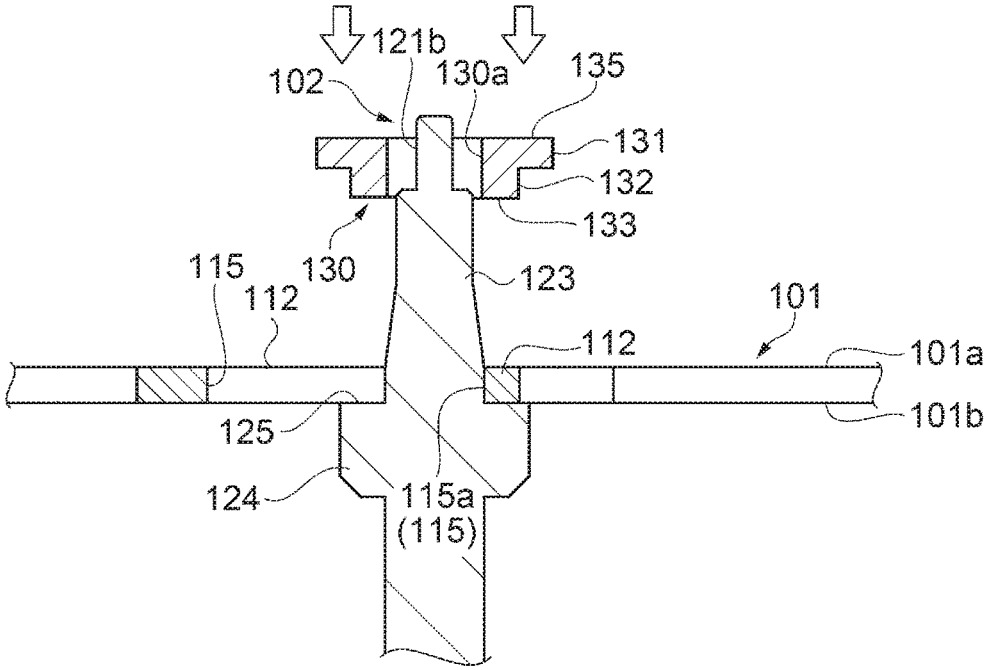
FIG. 10 is a schematic section view illustrating the process of inserting a staff member to the fastening member.

As shown in FIG. 10, the fastening member 130 is first placed with the small diameter part 132 facing the escape wheel 101 onto the other-end tenon 121*b* side of the pinion 102 that was inserted to the escape wheel 101 in step S31 above.

Figure 11:
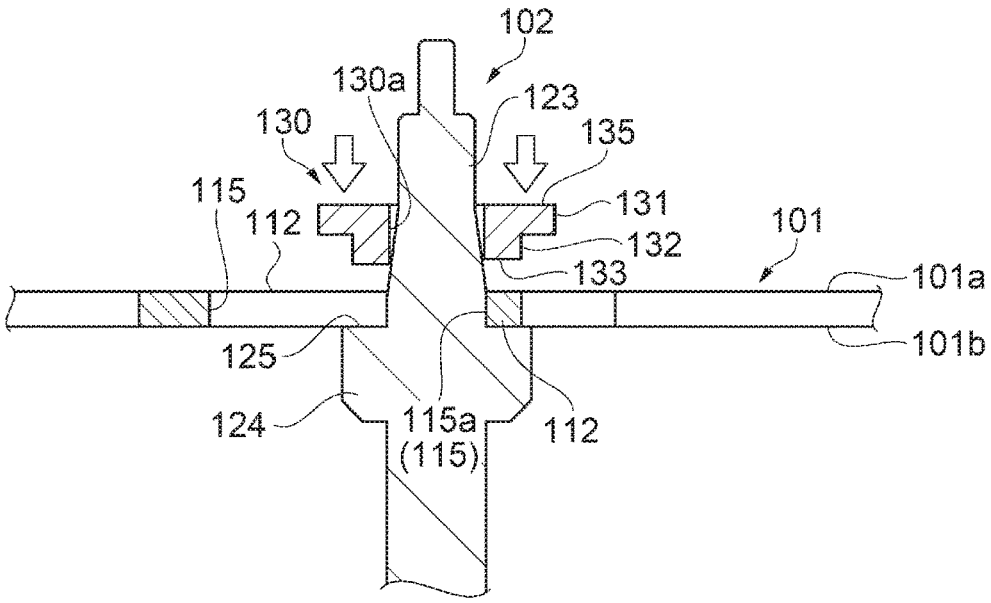
FIG. 11 is a schematic section view illustrating the process of inserting a staff member to the fastening member.

Then, as shown in FIG. 11, the fastening member 130 is pushed in the axial direction onto the press-fit staff 123 part of the pinion 102.

Figure 12:
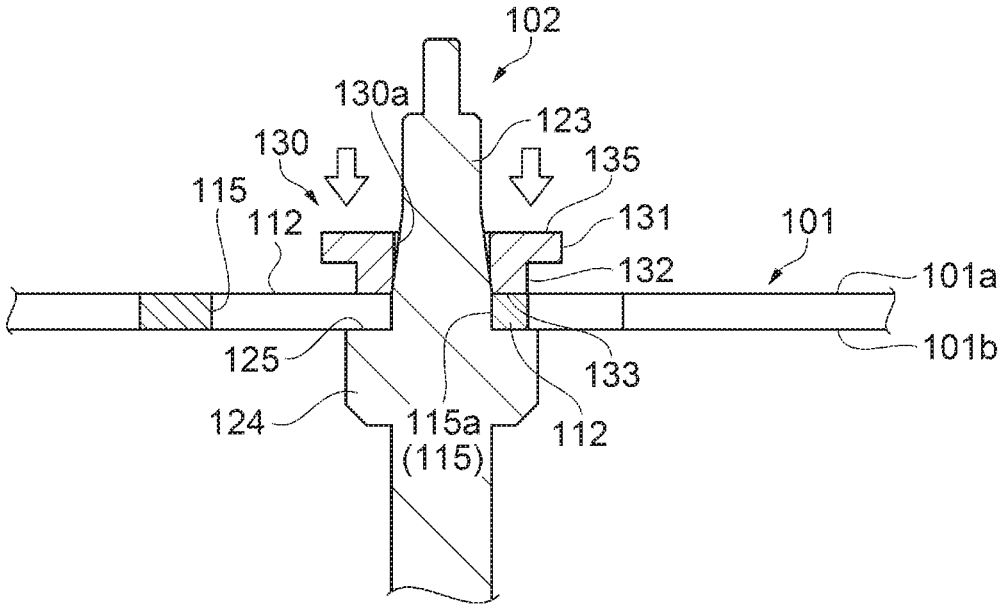
FIG. 12 is a schematic section view illustrating the process of inserting a staff member to the fastening member.

As shown in FIG. 12, the fastening member 130 is then pushed onto the pinion 102 until the first surface 133 of the small diameter part 132 of the fastening member 130 contacts the front side 101*a* of the ribs 112 of the escape wheel 101. As a result, the pinion 102 is inserted into the hole 130*a* of the fastening member 130.

In FIG. 12, of the small diameter part 132 of the fastening member 130, the part on the right side of the pinion 102 is the part 132*a* (see FIG. 7) that overlaps the ribs 112 in plan view along the axial direction, and the part on the left side of the pinion 102 is the part 132*b* (see FIG. 7) that overlaps the hole 115.

Next, the fastening member 130 is pressed in the axial direction to the escape wheel 101 side from the position shown in FIG. 12 (step S33 in FIG. 9). At this time, a rib 112 intercedes between the flange 124 and the part of the small diameter part 132 of the fastening member 130 on the right side of the pinion 102 (part 132*a*), but the hole 115 is between the part of the small diameter part 132 of the fastening member 130 on the left side of the pinion 102 (part 132*b*) and the flange 124, and a rib 112 is not present.

Figure 13:
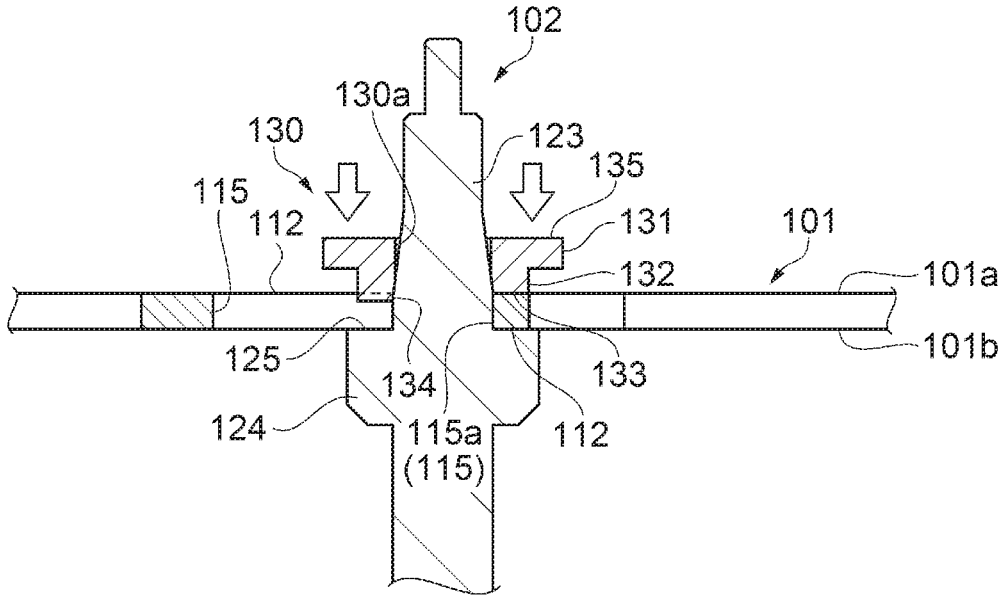
FIG. 13 is a schematic section view illustrating the process of inserting a staff member to the fastening member.

As described above, the Vickers hardness of the fastening member 130 is less than the Vickers hardness of the escape wheel 101, and is less than the Vickers hardness of the pinion 102. As a result, when the fastening member 130 is pressed down, the parts 132*b* that do not contact the ribs 112 plastically deform and protrude in the axial direction further inside the hole 115 than the parts 132*a* that contact the ribs 112. As a result, as shown in FIG. 13, a protrusion 134 protruding in the axial direction is formed on the fastening member 130. The distance the protrusion 134 protrudes from the first surface 133 of part 132*a* is preferably greater than or equal to 3 μm.

As described above, the inside diameter of the hole 130*a* of the fastening member 130 is smaller than the outside diameter of the press-fit staff 123 part of the pinion 102. As a result, when the fastening member 130 is pushed onto the press-fit staff 123, the fastening member 130 is pushed to the outside in the radial direction and affixed to the press-fit staff 123. Because the escape wheel 101 is thus fixed between the fastening member 130 and flange 124, separation of the escape wheel 101 from the pinion 102 can be prevented.

In addition, because a protrusion 134 protruding into the hole 115 is formed on the part 132*b* of the fastening member 130, rotation of the escape wheel 101 relative to the pinion 102 can be suppressed.

As a different method of manufacturing the escape wheel and pinion 35 according to this embodiment of the invention, the fastening member 130 may conceivably be preformed with a protrusion 134.

In this case, a machining process of cutting or grinding, for example, to form the protrusion 134 on the fastening member 130 is required in step S22. Then when inserting the pinion 102 to the hole 130*a* of the fastening member 130 in step S32, the protrusion 134 functioning as a key or fastening member must be desirably positioned to the hole 115 of the escape wheel 101. As a result, processing in step S22 and assembly in step S32 involve more steps, and the production cost increases according.

Furthermore, if processing precision in the machining process forming the protrusion 134 of the fastening member 130 varies in step S22, deviation or variation may also occur when positioning the protrusion 134 in the hole 115 of the escape wheel 101 in step S32, or a gap may occur between the escape wheel 101 (ribs 112) and the fastening member 130, and the quality of the escape wheel and pinion 35 may drop.

In this embodiment of the invention, the protrusion 134 is formed not in step S22 but in step S33 by press fitting the fastening member 130 and plastically deforming part of the fastening member 130. As a result, compared with the conceivable alternative method described above, there is no need for a cutting, grinding, or other machining step to form the protrusion 134 in step S22, and there is no need to specifically position the protrusion 134 of the fastening member 130 to the hole 115 of the escape wheel 101 in step S32. As a result, the number of steps required to produce the escape wheel and pinion 35 is reduced, and the production cost of the escape wheel and pinion 35 can be reduced.

Furthermore, because a protrusion 134 is formed on the part 132*b* that overlaps the hole 115 of the escape wheel 101 in a plan view of the fastening member 130, a protrusion 134 can be formed precisely according to the shape of the escape wheel 101.

In addition, because the first surface 133 of the part 132*a* that overlaps the ribs 112 of the fastening member 130 is pushed against the front side 101*a* of the ribs 112 by pressing the fastening member 130 into place, the gap between the escape wheel 101 (ribs 112) and the fastening member 130 (part 132*a*) can be reduced. The quality of the escape wheel and pinion 35 can thereby be improved.

However, force is also applied to the escape wheel 101 (ribs 112) held between the fastening member 130 and the flange 124 by press fitting the fastening member 130 in step S33. If the diameter D2 (see FIG. 6) of the first surface 133 of the small diameter part 132 of the fastening member 130 is greater than the diameter D3 (see FIG. 6) of the face 125 of the flange 124 that supports the escape wheel 101, the area to which force is applied from the small diameter part 132 to the escape wheel 101 becomes greater than the area supported by the flange 124. Therefore, the part of the escape wheel 101 that is positioned outside of the flange 124 is not supported by the flange 124 against the force applied from the first surface 133, and warping or other deformation of the escape wheel 101 or other damage may result.

In this embodiment of the invention, because the diameter D2 of the first surface 133 of the small diameter part 132 of the fastening member 130 is less than or equal to the diameter D3 of the face 125 of the flange 124, the part of the escape wheel 101 to which force is applied from the small diameter part 132 is smaller than the area supported by the flange 124. Therefore, warping or other deformation or other damage to the escape wheel 101 in step S33 can be suppressed.

Because force is applied to the second surface 135 of the large diameter part 131 when press fitting the fastening member 130, the diameter D1 of the second surface 135 of the large diameter part 131 is preferably large. If the fastening member 130 does not have a small diameter part 132, and the diameter D1 of the second surface 135 of the large diameter part 131 is greater than the diameter D3 of the face 125 of the flange 124, warping or other deformation or other damage to the escape wheel 101 may occur as described above.

In this embodiment of the invention, the fastening member 130 has a large diameter part 131 an a small diameter part 132, and the diameter D1 of the second surface 135 of the large diameter part 131 is greater than or equal to the diameter D2 of the first surface 133 of the small diameter part 132. The diameter D1 of the second surface 135 of the large diameter part 131 whereby the fastening member 130 is pushed can therefore be increased without making the diameter D2 of the first surface 133 of the small diameter part 132 larger than the diameter D3 of the face 125 of the flange 124. Therefore, the fastening member 130 can be easily pushed in step S32 and step S33. In addition, if the diameter D1 of the second surface 135 of the large diameter part 131 is made larger than the diameter D3 of the face 125 of the flange 124, the fastening member 130 can be easily pressed into place.

Through the steps described above, manufacturing an escape wheel and pinion 35 as a mechanical part can be completed in a single continuous manufacturing process.

The invention is described above with reference to a preferred embodiment thereof, but the invention is not limited thereto and can be modified and adapted in many ways without departing from the scope of the accompanying claims. Some examples of such variations are described below.

Variation 1

The configuration and plane shape of the escape wheel 101 described as an example of a rotating member according to the invention is not limited to the configuration shown in FIG. 5. The configuration of the escape wheel 101 (including such parts as the ribs 112, hole 115, flexible parts 113, and rim 111) may differ, and the shape in plan view may also differ.

Variation 2

The configuration and plane shape of the fastening member 130 according to the invention is not limited to the configuration shown in FIG. 6. For example, the fastening member 130 may have a trapezoidal shape in section view with a taper that decreases in diameter with proximity to the escape wheel 101, and in plan view may have a non-round shape.

Variation 3

In the manufacturing method of an escape wheel according to the invention, after inserting the pinion 102 to the escape wheel 101 in step S31, an oxidation process that forms a silicon oxide film of silicon dioxide ($SiO_2$) may be formed on the surface of the escape wheel 101. By applying an oxidation process to the escape wheel 101, the mechanical strength of the escape wheel 101 can be improved by the silicon oxide film formed on the surface of the escape wheel 101 from a material containing silicon. The oxidation process is preferably a thermal oxidation process at a high temperature of 1000° C. or higher.

Variation 4

A escape wheel and pinion 35 is described as an example of a mechanical part in the foregoing embodiment, but the invention is not so limited. The configuration and manufacturing method of a mechanical part according to the invention can also be applied to other mechanical parts.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2017-097043, filed May 16, 2017 is expressly incorporated by reference herein.

What is claimed is:

1. A mechanical part for a timepiece, the mechanical part comprising:

a pinion;

a wheel including a first hole and a rib, the pinion being inserted in the first hole, and the rib extending toward the pinion; and an annular fastening member configured to affix the wheel to the pinion, the fastening member being disposed in contact with the rib, a part of the fastening member being deformed and protruding into the first hole adjacent the pinion.

2. The mechanical part for the timepiece described in claim 1, wherein:

the first hole is formed surrounded by a plurality of the ribs; and the fastening member is formed so that part of the fastening member overlapping the first hole of the wheel protrudes in the axial direction when seen in plan view from the axial direction of the pinion.

3. The mechanical part for the timepiece described in claim 1, wherein:

a Vickers hardness of the fastening member is less than a Vickers hardness of the wheel.

4. The mechanical part for the timepiece described in claim 1, wherein:

the pinion has, on the opposite side of the wheel as the fastening member, a protrusion configured to protrude to an outside in a radial direction; and a diameter of a first surface of the fastening member that contacts the rib is less than or equal to a diameter of a surface of the protrusion that contacts the wheel.

5. The mechanical part for the timepiece described in claim 4, wherein:

a diameter of a second surface of the fastening member on the opposite side as the first surface is greater than or equal to a diameter of the first surface.

6. The mechanical part for the timepiece described in claim 1, wherein:

the wheel has a rim part including a plurality of teeth, and a flexible part and a second hole disposed between the rib and the rim part.

7. A timepiece comprising a mechanical part described in claim 1.

8. A manufacturing method of a mechanical part for a timepiece, the method comprising:

a process of forming a wheel having a rib and a first hole, the rib extending toward a center of the wheel, and the first hole being enclosed by the rib;

a process of inserting a pinion into the first hole of the wheel;

a process of inserting the pinion into a hole in a fastening member disposed annularly about the pinion so that the fastening member contacts the rib of the wheel; and a process of pressing the fastening member to deform part of the fastening member to protrude into the first hole of the wheel.

9. The manufacturing method of the mechanical part for the timepiece described in claim 8, wherein:

in the process of inserting the pinion into the hole in the fastening member, the inside diameter of the hole in the fastening member is smaller than the outside diameter of the pinion.

10. The mechanical part for the timepiece described in claim 1, wherein:

the fastening member includes a hole, a diameter of the hole being smaller than an outside diameter of a press-fit part of the pinion, and when the fastening member is pushed onto the press-fit part of the pinion, the diameter of the fastening member is forced to expand in an outward radial direction and the fastening member is affixed to the press-fit part of the pinion.

11. The mechanical part for the timepiece described in claim 1, wherein:

the wheel contains silicon.

* * * * *